US005450112A

United States Patent [19]

Scheffelin

[11] Patent Number: 5,450,112

[45] Date of Patent: Sep. 12, 1995

[54] LAMINATED FILM FOR INK RESERVOIR

[75] Inventor: Joseph Scheffelin, San Diego, Calif.

[73] Assignee: Hewlett-Packard Company, Palo Alto, Calif.

[21] Appl. No.: 995,868

[22] Filed: Dec. 23, 1992

[51] Int. Cl.[6] ..... B41J 2/175

[52] U.S. Cl. ..... 347/87

[58] Field of Search ..... 346/140 R; 220/450, 220/454; 222/107, 92, 94; 428/441, 458; 347/85–87; B41J 2/175

[56] References Cited

U.S. PATENT DOCUMENTS

| | | | |
|---|---|---|---|
| 4,422,084 | 12/1983 | Saito | 346/140 |
| 4,429,320 | 1/1984 | Hattori et al. | 346/140 R |
| 4,673,955 | 8/1987 | Ameyama et al. | 346/140 |
| 4,791,013 | 12/1988 | Koboshi et al. | 222/94 X |
| 5,006,378 | 4/1991 | Itaba et al. | 428/34.9 |
| 5,209,972 | 5/1993 | Super et al. | 428/458 X |
| 5,280,300 | 1/1994 | Fong et al. | 346/140 R X |

FOREIGN PATENT DOCUMENTS

| | | | |
|---|---|---|---|
| 0437363 | 7/1991 | European Pat. Off. | B41J 2/175 |
| 0519664 | 12/1992 | European Pat. Off. | B41J 2/175 |
| 2640018 | 6/1990 | France | F16J 3/02 |
| 1-56555 | 3/1989 | Japan . | |
| 2243328 | 10/1991 | United Kingdom | B32B 5/26 |

*Primary Examiner*—Joseph W. Hartary
*Assistant Examiner*—Alrick Bobb
*Attorney, Agent, or Firm*—Dennis G. Stenstrom

[57] ABSTRACT

An ink cartridge for a thermal ink jet printer containing a separate collapsible ink reservoir which is kept under negative pressure by a pressure regulator to prevent ink leakage. The collapsible reservoir has one or more flexible sidewalls connected at their periphery to form an ink reservoir, wherein said sidewalls include a plurality of layers. The pressure regulator comprises a pair of spaced parallel side plates urged apart by a spring toward the adjacent reservoir sidewalls whereby the reservoir is collapsible against the spring pressure to an essentially flat shape to permit substantially complete dispensation of ink from the reservoir.

22 Claims, 7 Drawing Sheets

LAMINATED FILM FOR INK RESERVOIR

FIELD OF THE INVENTION

The present invention relates generally to ink reservoirs for high speed ink printers and plotters, and more particularly, to ink reservoir materials.

BACKGROUND OF THE INVENTION

In printers containing ink reservoirs, the ink reservoir is ordinarily maintained under a sub-atmospheric or negative pressure so that ink will not leak or drool from the print head. Various types of ink reservoirs may be used including onboard ink reservoir cartridges which are mounted on the moveable printer carriage and remote or offboard ink reservoirs from which ink is brought to the print head on the printer carriage by tubing. In the onboard cartridges a polymer foam is ordinarily provided in the ink reservoir so that the capillary action of the foam will prevent ink from drooling from the print head. Polymeric foams of the type typically used for this purpose are non-biodegradable and thus cause environmental problems whenever a previously used cartridge is emptied and thrown away. In addition, the use of industrial foam in the ink reservoir restricts the operating pressure range of the ink cartridge and such foams ordinarily leave a chemical residue which is incompatible with and/or reacts adversely with printer ink. Similarly, the relatively long tubing used to convey ink from an offboard pressure reservoir to a printing head is not easily adaptable to deliver ink to the print head at different printing pressure ranges.

A collapsible ink reservoir for an inkjet printer is disclosed in U.S. Pat. No. 4,422,084 issued Dec. 20, 1983 to Saito. Negative pressure is maintained in a polypropylene ink bag by various types of springs which bias the bag walls apart from each other. The springs may be mounted inside of or externally of the ink bag but the spring pressure regulator construction does not result in substantially complete emptying of the ink bag and the bag itself is not carried on a printer carriage.

One example of an improved onboard ink reservoir cartridge is disclosed in U.S. patent application Ser. No. 07/717,735, filed Jun. 19, 1991, U.S. Pat. No. 5,359,353 entitled SPRING-BAG PRINTER INK CARTRIDGE WITH VOLUME INDICATOR filed by David S. Hunt and W. Bruce Reid and assigned to the assignee of the present invention. The cartridge disclosed in that application basically comprises a rectangular housing containing a flexible bag of ink, an ink filter and a print head which receives ink from the filter. A spring inside of the bag of ink urges its flexible walls apart from each other thus maintaining a negative or sub-atmospheric pressure in the reservoir which is overcome as ink is emitted from the print head.

Also of interest are prior co-pending U.S. patent applications Ser. No. 07/929,615, filed Aug. 2, 1992 by Kaplinsky, et al. entitled COLLAPSIBLE INK RESERVOIR STRUCTURE AND PRINTER INK CARTRIDGE; and Ser. No. 07/928,811, filed Aug. 12, 1992 by Khodapanah, al. entitled INK PRESSURE REGULATOR FOR A THERMAL INK-JET PRINTER; both owned by the assignee of the present application.

Further developments of this collapsible bag technology are disclosed in United States patent applications filed on Dec. 22, 1992 entitled METAL COVER ATTACHMENT TECHNIQUE FOR THERMAL INK-JET PEN by inventors Dale D. Timm, Jr., et al., Ser. No. 07/994,810; RIGID LOOP CASE STRUCTURE FOR THERMAL INK-JET PEN by inventors David W. Swanson, et al., Ser. No. 07/994,808; TWO MATERIAL FRAME HAVING DISSIMILAR PROPERTIES FOR THERMAL INK-JET CARTRIDGE by inventors David W. Swanson, et al., Ser. No. 07/995,221; and DOUBLE COMPARTMENT INK-JET CARTRIDGE WITH OPTIMUM SNOUT by inventors David W. Swanson, et al. all owned by the assignee of the present invention.

Further developments of this collapsible bag technology are disclosed in United States patent applications filed on the same day as this application entitled COLLAPSIBLE INK RESERVOIR AND INK-JET CARTRIDGE WITH PROTECTIVE BONDING LAYER FOR THE PRESSURE REGULATOR by inventors James H. Sykora, et al., Ser. No. 07/997,207; and NEGATIVE PRESSURE INK DELIVERY SYSTEM by inventors George T. Kaplinsky, et al., Ser. No. 07/995,851 both owned by the assignee of the present invention.

In order to provide an acceptable printer ink cartridge utilizing a collapsible ink bag or reservoir, there is a need for an ink bag or reservoir that is as flexible as possible in order to allow the reservoir bag to collapse in unimpeded manner to minimize stranded ink in the reservoir and to maintain the desired degree of negative pressure within the reservoir bag. The reservoir bag must also provide a strong moisture and gas barrier in order to prevent water loss form the reservoir, and prevent external contaminants such as air from entering the reservoir. Suitable materials for the reservoir should be materials capable of allowing the reservoir's peripheral edges to be sealed in order to form an ink reservoir that does not separate during normal use. In addition, the material used for the reservoir should be easily sealable in order to prevent leakage or migration of the ink from of the reservoir and chemically compatible and non-reactive with the ink contained therein.

Further, the reservoir should be puncture resistant because despite careful handling and packaging, the relatively rigid pressure regulator sideplates may during shipment, handling, or installation puncture the thin flexible reservoir walls. Although such puncturing is quite rare, this puncturing must be totally avoided without unduly thickening the reservoir walls so as to inhibit ink from being completely exhausted from the collapsible reservoir.

Finally, by providing a reservoir bag with adequate moisture/gas barrier allows the ink cartridges to be packaged without any special barrier packaging. This special barrier packaging currently requires packaging in sealed aluminum containers. Special packaging for protection from physical damage to the ink reservoir currently involves a plastic insert within the aluminum barrier protection. Elimination of this special packaging provides both environmental and cost benefits.

SUMMARY OF THE INVENTION

The present invention provides a collapsible ink reservoir to be maintained under negative pressure by a pressure regulator in a liquid ink cartridge, said ink reservoir comprising one or more flexible sidewalls each connected at their periphery to form an ink reservoir wherein said sidewalls include a plurality of layers of aluminum and plastic.

DESCRIPTION OF THE PREFERRED EMBODIMENT

Figure 1:
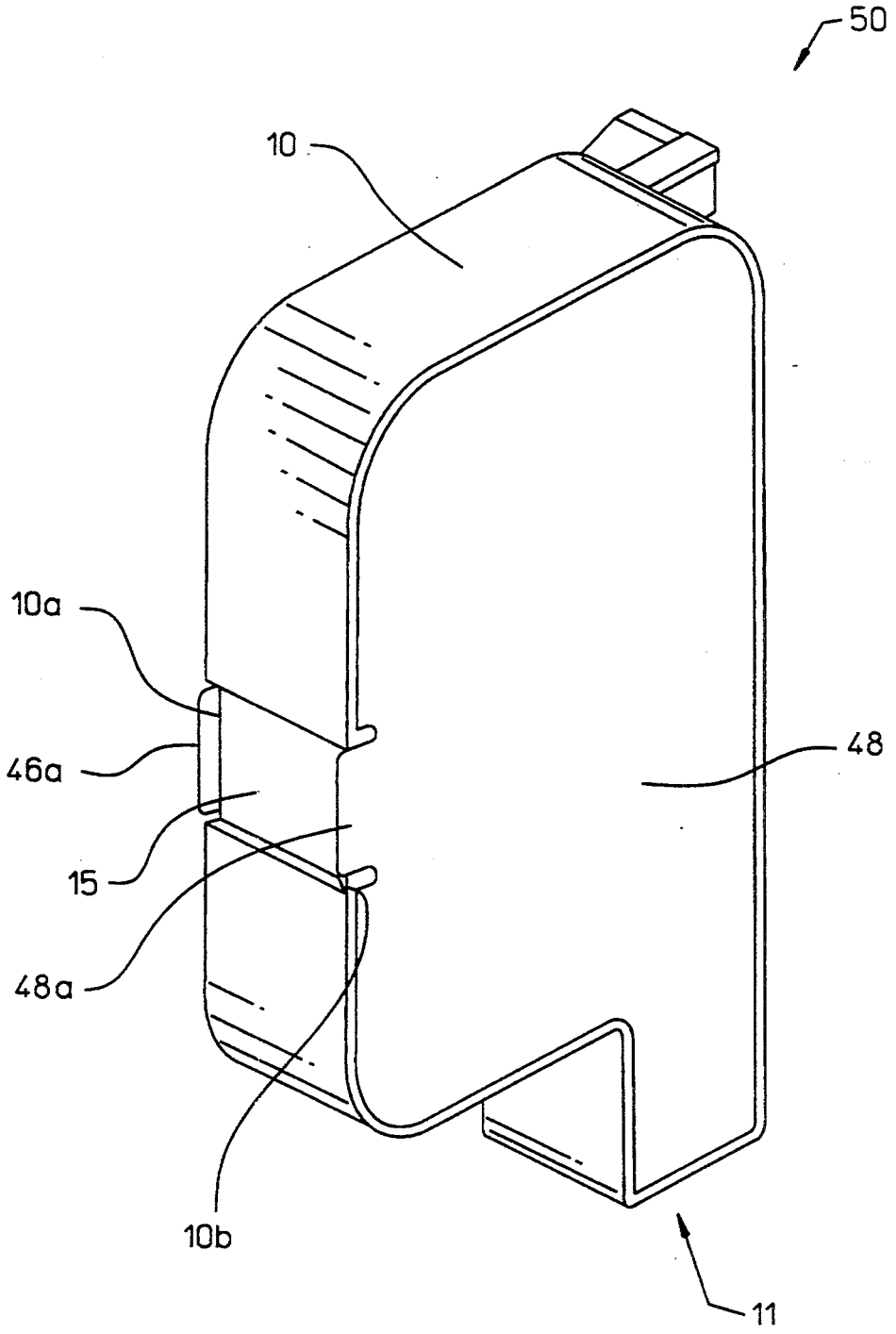
FIG. 1 is a perspective view of the ink cartridge assembly of the present invention.

Referring to FIG. 1, an ink cartridge 50 is depicted for enclosing a spring biased collapsible ink reservoir. This ink cartridge is usually made of opaque material such as plastic or metal and is comprised of an outer peripheral frame 10 and a pair of parallel opposed cover plates 46 (not shown) and 48 which are affixed to the outer peripheral frame 10 by welding, gluing or press fitting after installation of the internal components. A preferred method of affixing cover plates 46 (not shown), 48 to outer peripheral frame 10 is described in an United States patent application filed on the same day as this application entitled METAL COVER ATTACHMENT TECHNIQUE FOR THERMAL INK-JET PEN, by inventors Dale D. Timm, et. al, Ser. No. 07/994,810, which is herein incorporated by reference. The snout portion 11 of the ink cartridge 50 has an ink discharge aperture 12 (not shown) in its end portion (at the bottom in FIG. 1) to which is affixed an electrically driven print head (not shown).

Figure 2:
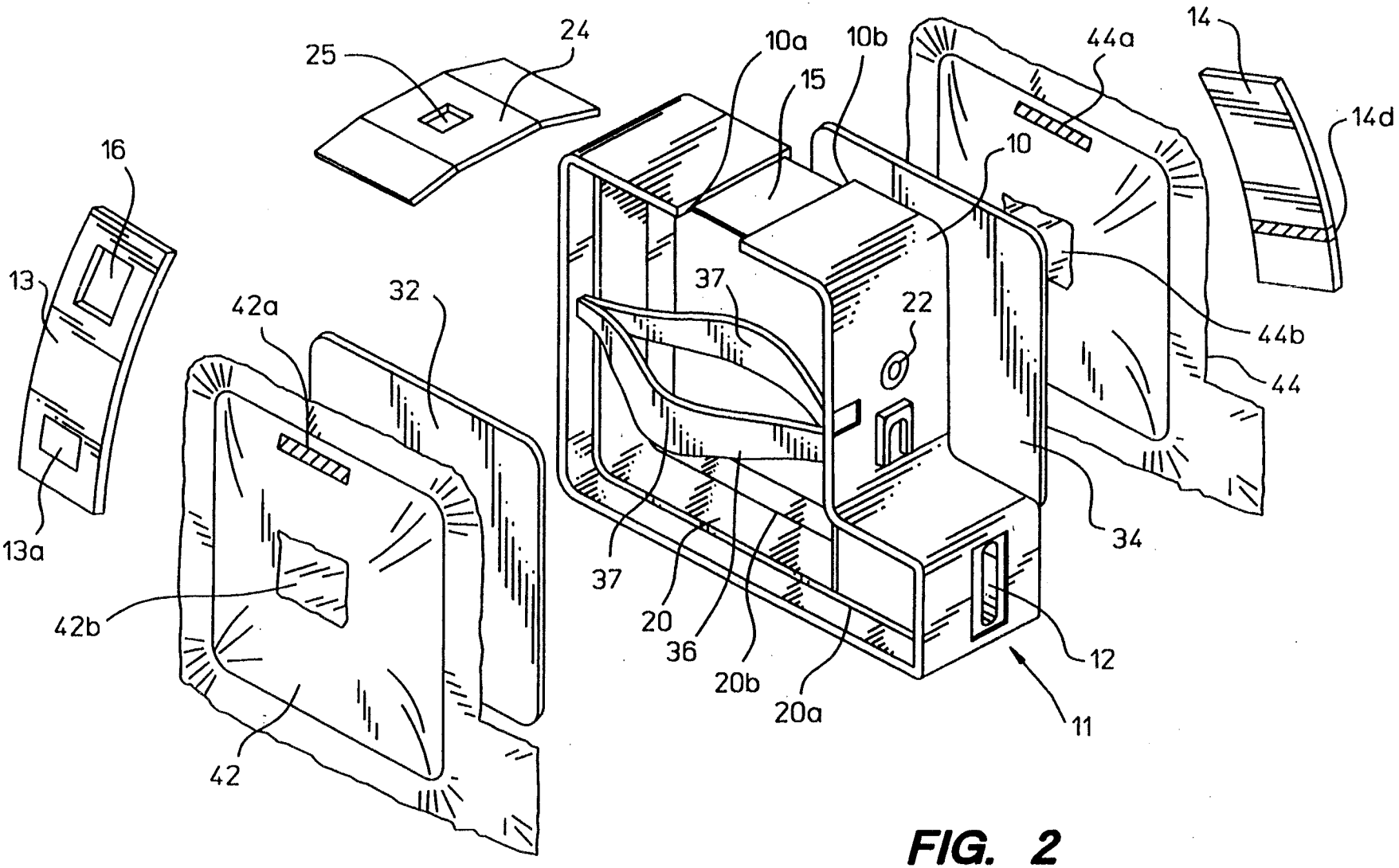
FIG. 2 is an exploded view of the ink cartridge and collapsible reservoir assembly of the present invention.

Referring to FIG. 2, the sidewalls of the reservoir are identified at 42, 44. A collapsible reservoir system comprised of a relatively rigid inner peripheral frame 20 and a pair of ink reservoir sidewalls 42, 44 at least one of which is flexible material attached thereto is mounted in outer peripheral frame 10. Preferably, inner peripheral frame 20 is molded with the outer peripheral frame 10 in a two step injection molding process. Preferably inner peripheral frame 20 is formed of a softer and lower melting point plastic than the plastic of outer peripheral frame 10 to permit heat bonding of the reservoir sidewalls 42, 44 thereto along the side edges **20*a*, 20*b* of inner peripheral frame 20. Alternatively, inner frame 20 may be separately constructed with some flexibility to assist in mounting it in the peripheral frame 10, but the frame 20 is rigid relative to the flexible ink reservoir sidewalls described below. The inner peripheral frame 20 has a pair of opposite side edges 20*a*, 20*b* to which the flexible ink reservoir sidewalls 42, 44 are respectively joined as by heat welding at their peripheral edges to form the external reservoir structure. A preferred method of constructing inner and outer peripheral frames 20, 10** is described in an United States patent application filed on the same day as this application entitled TWO MATERIAL FRAME HAVING DISSIMILAR PROPERTIES FOR THERMAL INK-JET CARTRIDGE by inventors David W. Swanson, et. al, Ser. No. 07/994,807, which is herein incorporated by reference.

Figure 3:
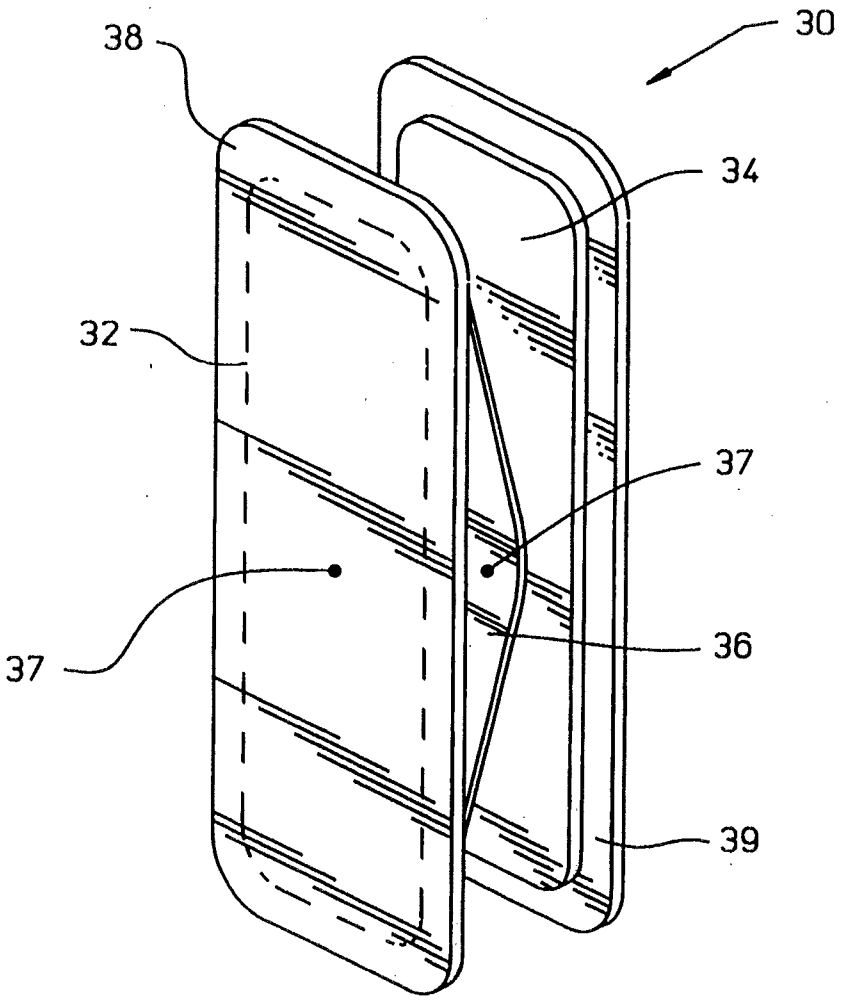
FIG. 3 is a perspective view of the pressure regulator assembly.

FIG. 3 shows the pressure regulator 30 assembly. The pressure regulator sideplates 32, 34 may be individually cut from a continuous strip of metal such as stainless steel, each plate being of generally rectangular configuration with rounded corners to minimize damaging the flexible reservoir sidewalls. The bow springs 36 also may conveniently be cut from a common strip of metal such as stainless steel. The bow spring 36 may be affixed, preferably by spot or laser welding at the apexes of each of its bights 37 centrally onto each of the sideplates 32, 34. An optional protective bonded layer in the form of a thin, but tough polyethylene cover layer 38, 39 having an acrylic adhesive on one surface thereof is press bonded to the outer surface of each side plate 32, 34. The cover layers 38, 39 are each sized slightly larger than the side plates 32, 34 so that a marginal width of a few millimeters of the cover layers extends beyond each edge of the metal plates 32, 34 to prevent those edges from contacting the comparatively delicate reservoir wall sidewalls 42, 44.

The pressure regulator 30 is centrally positioned in the inner peripheral frame 20 and the two flexible ink reservoir sidewalls or 42, 44 are then heat bonded or cemented at their peripheral edges to the outer edge walls **20*a*, 20*b* of the inner peripheral frame 20, respectively, with care being taken to maintain the central positioning at all time of the regulator 30 in inner peripheral frame 20 between the flexible sidewalls 42, 44. The reservoir sidewalls 42, 44 may then be securely affixed to the pressure regulator 30 sideplates 32, 34 preferably by heat bonding the reservoir sidewalls 42, 44 to the sideplates 32. 34 or to the cover layers 41, 51 if present in the area shown as 42*b*, 44*b* in FIG. 2. This heat sealing has the primary purpose of preventing relative motion between the pressure regulator 30 and preventing direct contact of the metal sideplates 32, 34 with the relatively delicate reservoir sidewalls 42, 44 to prevent the edges of the sideplates from cutting or puncturing the sidewalls. The cover plates 46, 48 are then affixed to the outer peripheral frame 10 as described above. A preferred method of constructing ink cartridge 50** is described in an United States patent application filed on the same day as this application entitled RIGID LOOP CASE STRUCTURE FOR THERMAL INK-JET PEN by inventors David W. Swanson, et. al, Ser. No. 07/994,808, which is herein incorporated by reference.

Figure 4:
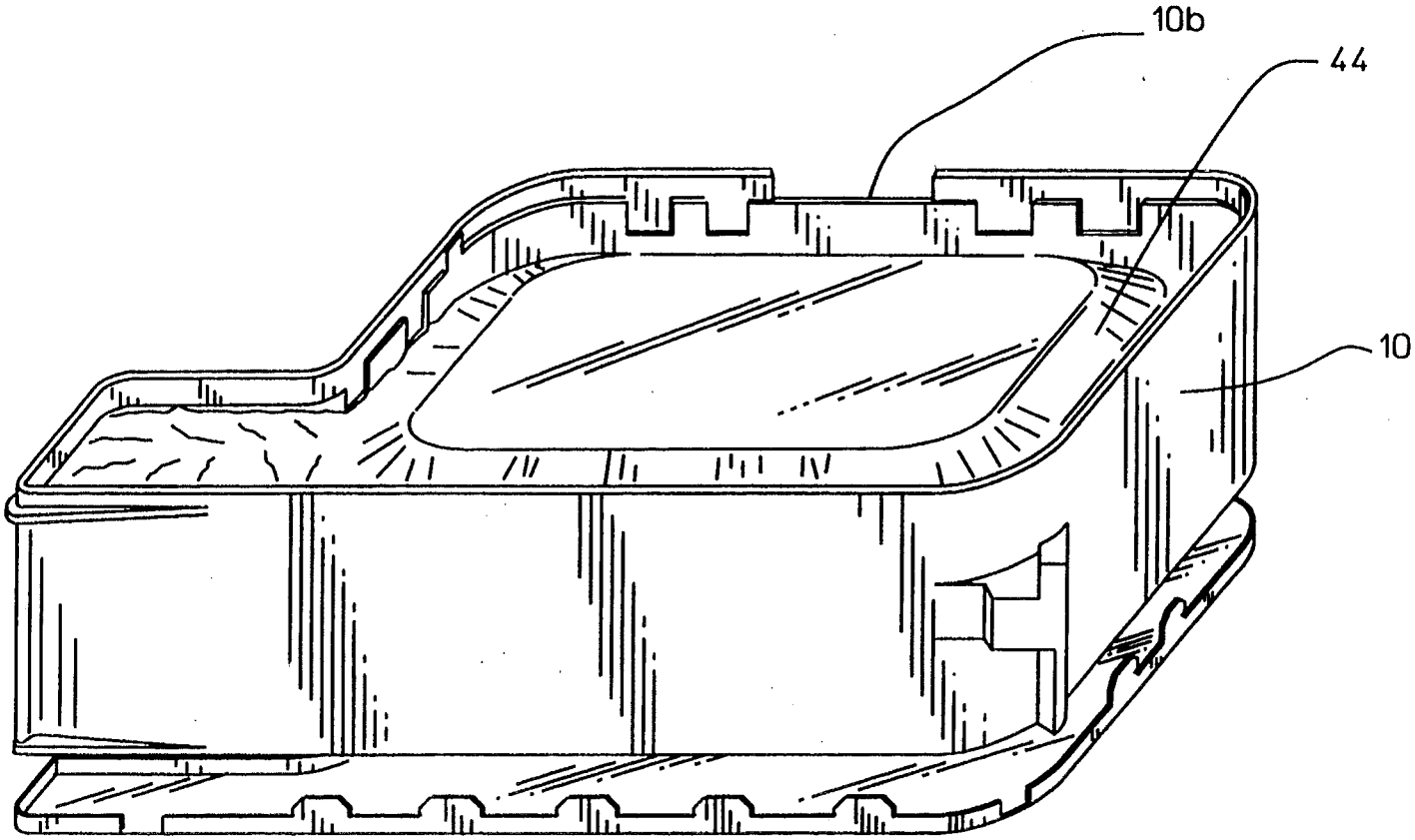
FIG. 4 is a perspective view of ink cartridge with cover plates removed to show collapsible ink reservoir of the present invention attached to the inner peripheral frame.
Figure 6:
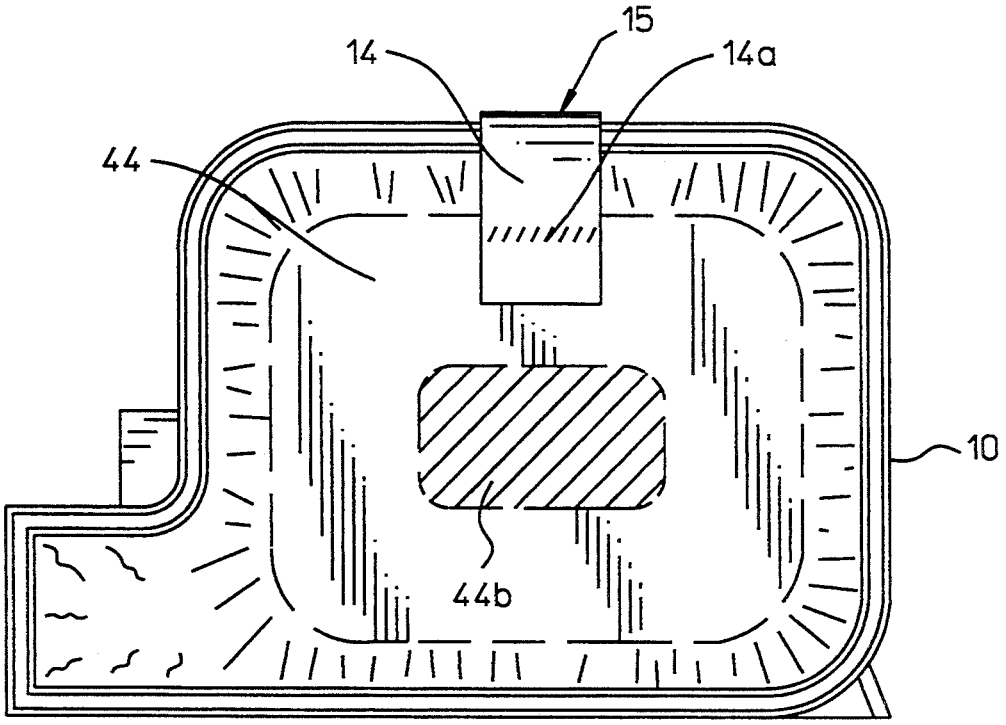
FIG. 6 is a side view of the ink cartridge without the outer cover plate.
Figure 7:
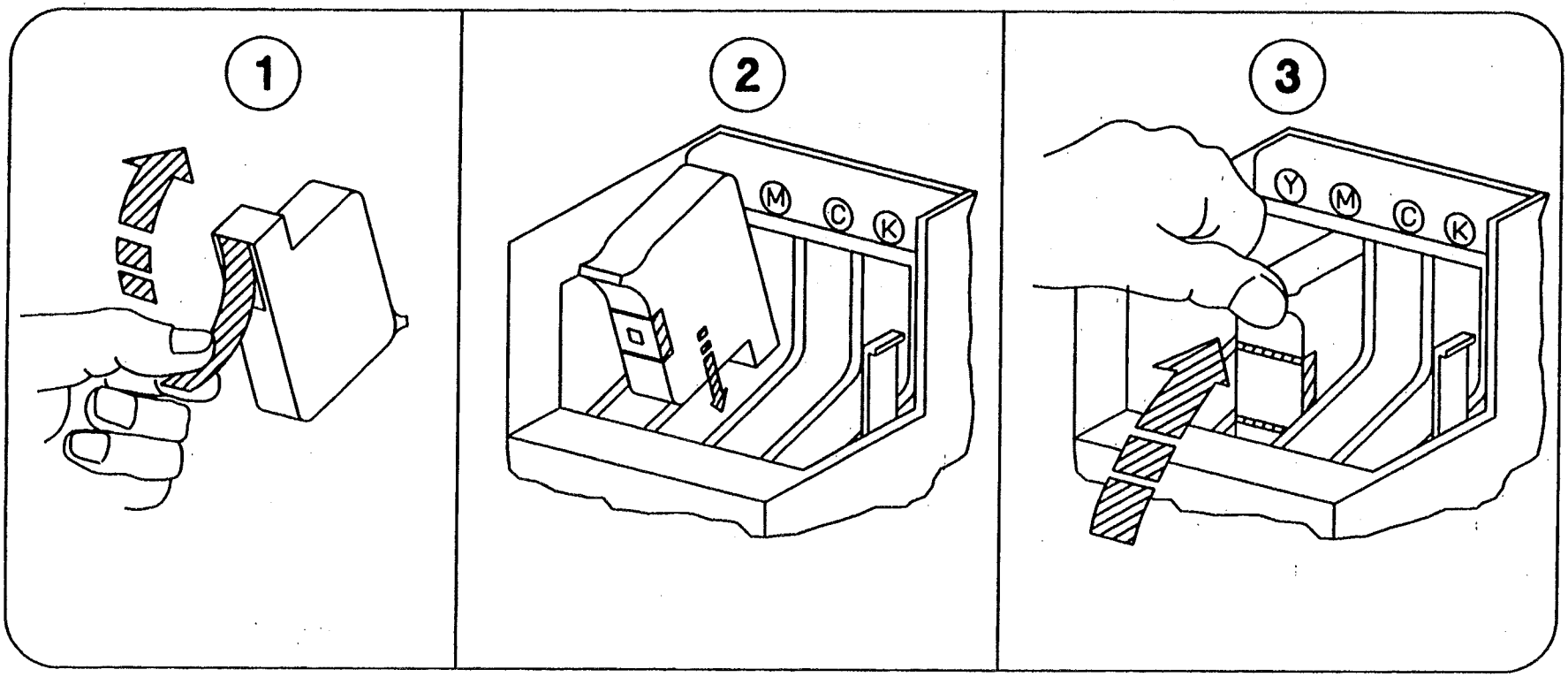
FIG. 7 is a simplified perspective view of the installation of the ink cartridge of the present invention.

Referring to FIGS. 1, 2 and 4, peripheral outer frame 10 is provided with a pair of spaced parallel slots **10*a* and 10*b* on opposite sides of reduced thickness channel 15. Cover plates 46, 48 provide tab extensions 46*a*, 48*b*, respectively, as shown in FIGS. 1 and 6. Tabs 46*a* and 48*a* align with slots 10*a*, 10*b*, respectively, to provide a passageway for thin indicator strips 13 and 14 which are cemented or heated sealed to opposite reservoir sidewalls 42, 44, respectively. The sealed areas of indicator strip 13, 14 and sidewalls 42, 44 are shown as areas 13*a*, 14*a* and 42*a*, 44*a*, respectively, in FIGS. 2 and 6**.

Figure 5:
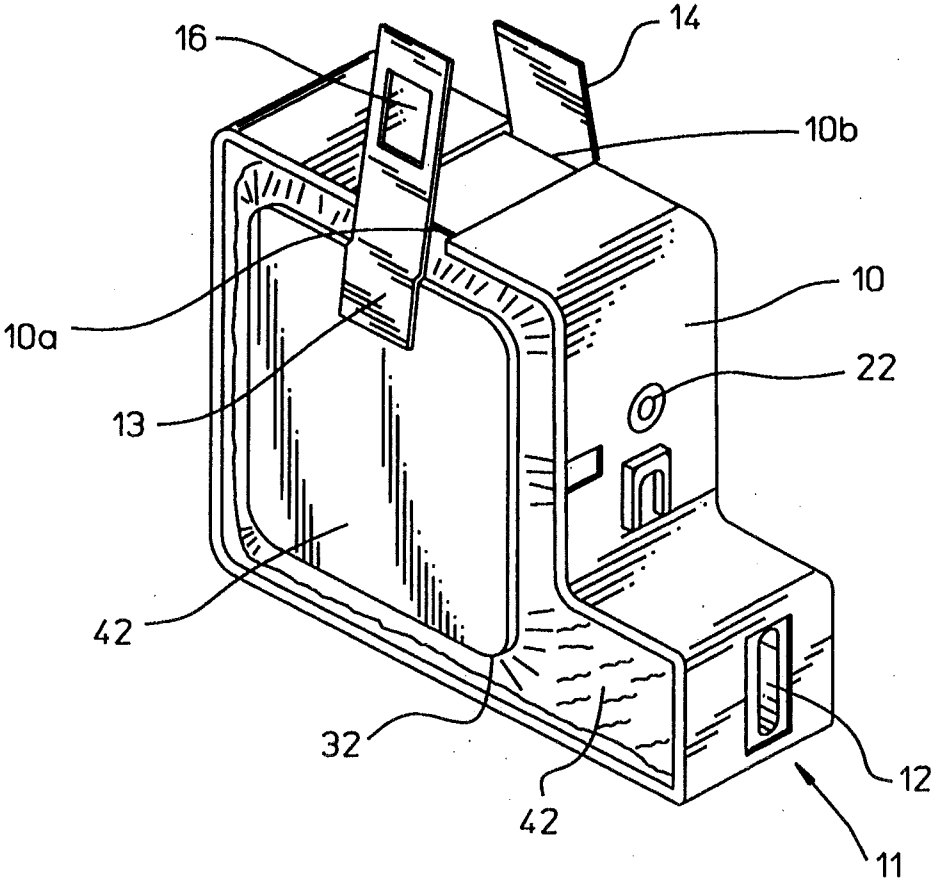
FIG. 5 is a perspective view of the ink cartridge assembly and ink level indicator device with the cover plate removed.

Referring to FIGS. 1 and 5, indicator strips 13, 14 pass between tabs **46*a*, 48*a* and slots 10*a*, 10*b* and fold over each other into reduced channel 15. Indicator strip 14 is the lower or inside indicator strip having a color (e.g., green) which provides an indicia visible through a window 16 in indicator strip 13 when the indicator strips 13, 14 are in place. Indicator strip 13 is preferably of the same color (e.g., black) as the peripheral frame material. Reduced thickness channel 15 in peripheral outer frame 10 receives the overlying indicator strips 13 and 14. A window device 24 having a stationary viewing window 25 therein is placed over and aligned with the reduced thickness channel 15 to provide a passageway for movement of the indicator strips 13, 14. The movement of the window 16 in indicator strip 13 permits visual observation of the movement of indicator strip 13 and of the contrasting color (e.g., green) indicator strip 14**.

The reservoir is filled with ink via port 22 which is subsequently plugged for shipment. The required means which fire the ink droplets through the orifices 12 is conventional. FIG. 12 shows the ink cartridge mounted in a printer carriage to show that window device 24 and the ink level indicator band are visible when the cartridge 50 is installed in the printer.

As ink is withdrawn from the reservoir, the flexible sidewalls 42, 44 of the ink reservoir and the pressure regulator sideplates 32, 34 gradually move towards each other until the spring is in an essentially flat configuration with the two sideplates 32, 34 coming virtually into contact with each other so that the reservoir is substantially completely emptied of ink.

The material used for reservoir sidewalls 42, 44 should be flexible, relatively puncture resistant, impermeable to moisture and chemically compatible and nonreactive with the ink contained therein to prevent leakage or migration of the ink out of the reservoir, and impermeable to external contaminants such as air, dust, liquids and the like. Moreover, the reservoir material must meet cartridge shelf-life requirements for water loss and air gain over approximately eighteen months of storage and shipping plus six months in a heated printer environment. Excessive water loss will change ink composition and thereby degrade print quality. Excessive air gain leads to loss of back-pressure and ink leakage from the print head.

The seal between reservoir sidewalls 42, 44 and inner peripheral frame 20 must also survive shelf-life requirements with sufficient strength to pass rough handling such as dropping, vibration, shock, altitude and high temperature. While it is possible to use adhesives for sealing, it is advantageous if the reservoir material allows for the heat sealing of the sidewalls 42, 44 to: the inner peripheral frame 20 frame, sideplates 30, 32, cover layers 38, 39, and indicator strips 13, 14. Moreover, it is further required that sidewalls 42, 44 be heat sealable onto themselves in order to seal through the "wrinkles" that naturally occur at the curved peripheries of the sidewalls 42, 44. Finally, the reservoir material must be suitable for a high speed automated assembly process.

Various combinations of materials were tried in order to meet the reservoir sidewall requirements for flexibility, moisture/gas barrier, chemical resistance, mechanical toughness, heat sealability and cost.

With respect to the barrier requirement, a single layer of aluminum foil far exceeds the barrier requirement, but the minimum thickness of ⅓ mil is far too rigid to meet the flexibility requirements for the sidewalls. Other materials investigated were various plastic carrier films coated with materials such as aluminum, polyvinylidene chloride (PVDC or Saran), glass or fluorohalocarbon (Aclar).

Polyethylene teraphthalate (PET or Polyester), Polypropylene (PP), Nylon and polyethylene (PE) were investigated as possible carriers. Based on numerous tests of different combinations PET was chosen as the preferred carrier material.

For sealability, adhesive laminating of the layers allowed for more choices of sealant materials, but the resulting structure was more rigid than when extrusion coating was used. Thus, the extrusion coating method was chosen and low density polyethylene (LDPE) was chosen as the sealant. As discussed above, sealing through "wrinkles" a two-sided coating of sealant.

Numerous combinations of LDPE, PET, aluminum (ALU) and LDPE were investigated with varying degrees of success in obtaining the desired functional requirements discussed above. Among the combinations investigated LDPE-PET-ALU//ALU-PET-LDPE was chosen as the preferred embodiment for the reservoir sidewalls. In the above preferred embodiment "-" means a coating was applied to a film and "//" means two films were adhesively laminated. The symmetry of the preferred embodiment also resulted in less curl and easier assembly of the reservoir sidewalls.

The above preferred embodiment for the reservoir sidewalls is manufactured by the following process. Polyethylene teraphthalate (PET or Polyester) in pellet form is blown extruded into a 48 gauge thick film, biaxially stretched film. The PET film is then coated with a 135 angstrom thick aluminum coating by vacuum deposition on one side. Two aluminum coated PET films are adhesively laminated together (aluminum to aluminum) using a 0.1 mil thick polyester based adhesive. The PET lamination is extrusion coated with a 0.05 mil thick polyester based adhesive primer, and then with a 0.7 mil thick Low Density Polyethylene (LDPE) on each side. The finished laminated film is then cut into the desired shape and size.

Persons skilled in the art will readily appreciate that various modifications can be made from the preferred embodiment thus the scope of protection is intended to be defined only by the limitations of the appended claims. For example, an ink reservoir having a single flexible sidewalls wall instead of two flexible sidewalls might be constructed. In this instance, the pressure regulator need only have a single sideplate urged into engagement by a spring with the single flexible sidewalls reservoir wall.

What is claimed is:

1. A collapsible ink reservoir maintained under negative pressure by an internal pressure regulator for a liquid ink printer cartridge comprising one or more flexible sidewalls, each sidewall having peripheral edges, said sidewalls connected at their peripheral edges to form an ink reservoir, wherein said sidewalls include a plurality of layers, said plurality of layers comprising two laminated layers, each laminated layer comprising a carrier layer having two surfaces, a barrier layer formed on a first surface of said carrier layer, and a sealant layer formed on a second surface of said carrier layer, each said laminated layer joined to the other laminated layer through adhesive lamination of each said barrier layer to the other, said printer cartridge further including an outer peripheral frame and an inner peripheral frame, said inner peripheral frame comprising a softer and lower melting point material than said outer peripheral frame, with said peripheral edges of each said sidewall bonded to said inner peripheral frame.

2. An ink reservoir for use in a printer comprising:

a frame member;

a first sidewall having peripheral edges and affixed at said peripheral edges to said frame member; and a second sidewall having peripheral edges and affixed at said peripheral edges to said frame member, said second sidewall being flexible and including layered means for providing a gas and moisture impermeable barrier for the ink reservoir, said layered means comprising two laminated layers, each laminated layer comprising a carrier layer having two surfaces, a barrier layer formed on a first surface of said carrier layer, and a sealant layer formed on a second surface of said carrier layer, each said laminated layer joined to the other laminated layer through adhesive lamination of each said barrier layer to the other, said sealant layers being heat-sealable to said frame member and to each other.

3. The ink reservoir of claim 2 wherein said frame member has an opening for dispensing ink from the reservoir.

4. The ink reservoir of claim 2 wherein said layered means is heat sealable to said frame member.

5. The ink reservoir of claim 2 wherein said layered means is heat sealable onto itself.

6. The ink reservoir of claim 2 wherein said layered means comprises a lamination created by extrusion coating.

7. The ink reservoir of claim 2 wherein said layered means comprises a lamination created by adhesive connection.

8. The ink reservoir of claim 2 wherein said layered means comprises a lamination created by a combination of extrusion coating and adhesive connection.

9. The ink reservoir of claim 2 which further includes means for maintaining the ink reservoir under negative pressure.

10. The ink reservoir of claim 9 wherein said means for maintaining the ink reservoir under negative pressure comprises a spring affixed to first and second sideplates.

11. The ink reservoir of claim 10 wherein said first and second sideplates are affixed to said first sidewall and said second sidewall, respectively.

12. The ink reservoir of claim 8 wherein:

said carrier layer is selected from the group consisting of polyethylene teraphthalate, polypropylene, polyethylene, and nylon;

said barrier layer is selected from the group consisting of aluminum, polyvinylidene chloride, glass, and fluorohalocarbon; and said sealant layer is low density polyethylene.

13. The ink reservoir of claim 12 wherein:

said carrier layer is polyethylene teraphthalate;

said barrier layer is aluminum; and said sealant layer is low density polyethylene.

14. An ink reservoir for use in a printer comprising:

a frame member;

a first sidewall having peripheral edges and affixed at said peripheral edges to said frame member; and a second sidewall having peripheral edges and affixed at said peripheral edges to said frame member, said first sidewall and said second sidewall both being flexible and including layered means for providing a gas and moisture impermeable barrier for the ink reservoir, said layered means comprising two laminated layers, each laminated layer comprising a carrier layer having two surfaces, a barrier layer formed on a first surface of said carrier layer, and a sealant layer formed on a second surface of said carrier layer, each said laminated layer joined to the other laminated layer through adhesive lamination of each said barrier layer to the other, said sealant layers being heat-sealable to said frame member and to each other.

15. The ink reservoir of claim 14 wherein said frame member has an opening for dispensing ink from the reservoir.

16. The ink reservoir of claim 14 wherein said layered means is heat sealable to said frame member and onto itself.

17. The ink reservoir of claim 16 wherein said layered means comprises a lamination created by a combination of extrusion coating and adhesive connection.

18. The ink reservoir of claim 17 which further includes means for maintaining the ink reservoir under negative pressure.

19. The ink reservoir of claim 18 wherein said means for maintaining the ink reservoir under negative pressure comprises a spring affixed to first and second sideplates.

20. The ink reservoir of claim 19 wherein said first and second sideplates are affixed to said first sidewall and said second sidewall, respectively.

21. The ink reservoir of claim 18 wherein:

said carrier layer is selected from the group consisting of polyethylene teraphthalate, polypropylene, polyethylene, and nylon;

said barrier layer is selected from the group consisting of aluminum, polyvinylidene chloride, glass, and fluorohalocarbon; and said sealant layer is low density polyethylene.

22. The ink reservoir of claim 21 wherein:

said carrier layer is polyethylene teraphthalate;

said barrier layer is aluminum; and said sealant layer is low density polyethylene.

* * * * *